US006044771A

United States Patent [19]

Nguyen

[11] Patent Number: 6,044,771

[45] Date of Patent: Apr. 4, 2000

[54] END STRUCTURE ASSEMBLY FOR HOPPER CAR

[75] Inventor: Don Phu Nguyen, Oakville, Canada

[73] Assignee: National Steel Car Ltd., Canada

[21] Appl. No.: 09/016,583

[22] Filed: Jan. 30, 1998

[51] Int. Cl.[7] ..... B61D 3/00

[52] U.S. Cl. ..... 105/247; 105/248

[58] Field of Search ..... 105/247, 248, 105/249

[56] References Cited

U.S. PATENT DOCUMENTS 3,605,635 9/1971 Stark ..... 105/248
3,606,841 9/1971 Johnson et al. ..... 105/248
4,690,071 9/1987 Billingsley et al. ..... 105/247
4,922,833 5/1990 Coulborn et al. ..... 105/248

*Primary Examiner*—S. Joseph Morano
*Assistant Examiner*—Robert J. McCarry, Jr.
*Attorney, Agent, or Firm*—Oldham & Oldham Co., L.P.A.

[57] ABSTRACT

A transition section for a railway hopper car carries structural loads from an endmost hopper of the hopper car into the hopper car end structure, whence the loads are transferred to and from other cars via the coupler, and into the rail car truck. The sidewall of the endmost hopper has an extension that mates smoothly with a curved flange extending from the hopper end structure, such that the transition varies smoothly in section.

17 Claims, 8 Drawing Sheets

END STRUCTURE ASSEMBLY FOR HOPPER CAR

FIELD OF THE INVENTION

This invention relates to structures for railcars such as may be applicable, for example, to the reinforcement of hopper cars, and, in a specific example, to the structural transition from a hopper of a hopper car body to the rail car truck end structure.

BACKGROUND OF THE INVENTION

The design of railway hopper cars is governed by three main requirements. First, the fully loaded weight of the car must not exceed 286,000 lb. Thus to maximize useful, load car designers try to minimize car weight. At present an empty grain hopper car may typically weigh about 70,000 lb., such that lading in excess of 200,000 lb. is permissible. Second, the car must withstand a draft load which may be in excess of 500,000 Lbs. Third, the car must not buckle under buff loads when slowing or stopping. Under the first, dead weight, loading condition the car may be modelled as a simply supported hollow beam carrying a distributed vertical load in excess of 200,000 lb., with a corresponding bending moment distribution. Under the second, tensile draft, and third, compressive buff, loading conditions the car is like a column, taking tensile and compressive loads.

The general structure of contemporary curved-sided hopper cars can be idealized as a load bearing monocoque in the form of a hollow, downwardly opening, generally C-shaped, thin walled, low aspect ratio column. At each column end, the load is transferred through a transition structure from the shell into a stub sill and coupler by which the railcar is connected to the next rail car. The challenge in designing the structure for a hopper car, in general, is to reduce the mass of the thin shell, and any supporting structure, to a minimum while still maintaining the structural integrity required to withstand the given loads, and to transfer those loads between the couplers and the body shell. When the shell is made too thin it fails in compression due either to global buckling of the structure, or to the local buckling phenomenon of wrinkling. In such a hollow shell structure, the ability to resist the compressive buff load, without buckling, requires that the principle longitudinal structural components of the car, those being the roof and side walls, work together as a single integrated structure.

The hopper car's side structure contributes to its ability to withstand compressive buff loads and lateral loads in comers as well as the customary loads experienced due to lading. The side structure and the roof structure also interact to stabilize each other. Side sheets have been made of several rolled sheets cut to the arc length measured from the side sill to the top chord, with their rolling direction perpendicular to the longitudinal axis of the car, butt welded together along their side edges. The side sheets require a significant amount of assembly time and effort, and the resulting butt-welded seams are oriented perpendicularly to cyclic tensile draft loads.

Hopper car designs also face the difficulty of arranging the transition structure for carrying loads from the end hoppers to the shear plates and bolsters which actually rest on the trucks, that is, in the area where the shear plate, the end hopper slope sheet, and the hopper come together. Current industry designs do not tend to increase the stiffness of the side construction from the bolster toward the end hopper compartment. It is advantageous to provide an increase in the local stiffness of the hopper shear plate, the hopper sheet extension, and the side sill, but without increasing the thickness of those members over their full lengths. If the side sills are made thicker over their entire lengths, a large amount of material would be added that would not be used effectively.

In general, it would be advantageous to have an improved hopper car shell structure. It would be advantageous to have, and there has been a long felt need for, an improved hopper car side sheet. Finally, there has been a long felt need for an improved structure to transfer the load from the hopper car shell structure to the trucks of the railcar.

SUMMARY OF THE INVENTION

In one aspect of the invention, there is a transition section for carrying structural loads between an end hopper of a railway hopper car and a railway hopper car end structure carried on a truck, the end hopper having a side sheet, said transition section comprising a side sheet extension extending between the side sheet and the end structure, the side sheet extension varying smoothly in section between the side sheet and the end structure.

In another aspect of the invention, the hopper car having a side sill of constant section extending between, and attached to, the end hopper and the end structure, the transition section is such that the side sheet extension reinforces the side sill between the end hopper and the end structure.

In a third aspect of the invention, the end structure having an horizontally extensive shear plate, the hopper side sheet having an end slope edge generally oriented toward the end structure, the transition section further comprises a shear plate extension formed integrally with the shear plate, the extension having a root where if meets the shear plate and a tip distant therefrom, the shear plate extension tapering smoothly from the root to the tip, and the shear plate extension bent downwardly from the shear plate on a smooth, continuous curve; and the side sheet extension has a smoothly curved profile which melds with the end slope edge and has a distal portion for lying smoothly against the end structure and the shear plate extension lies along and is attached to at lest a portion of the side sheet extension and acts as a flange therefor.

BRIEF DESCRIPTION OF THE DRAWINGS

For a better understanding of the present invention and to show more clearly how it may be carried into effect, reference is made by way of example to the accompanying drawings, which show an apparatus according to the preferred embodiment of the present invention and in which.

DETAILED DESCRIPTION OF THE PREFERRED EMBODIMENT

Figure 1:
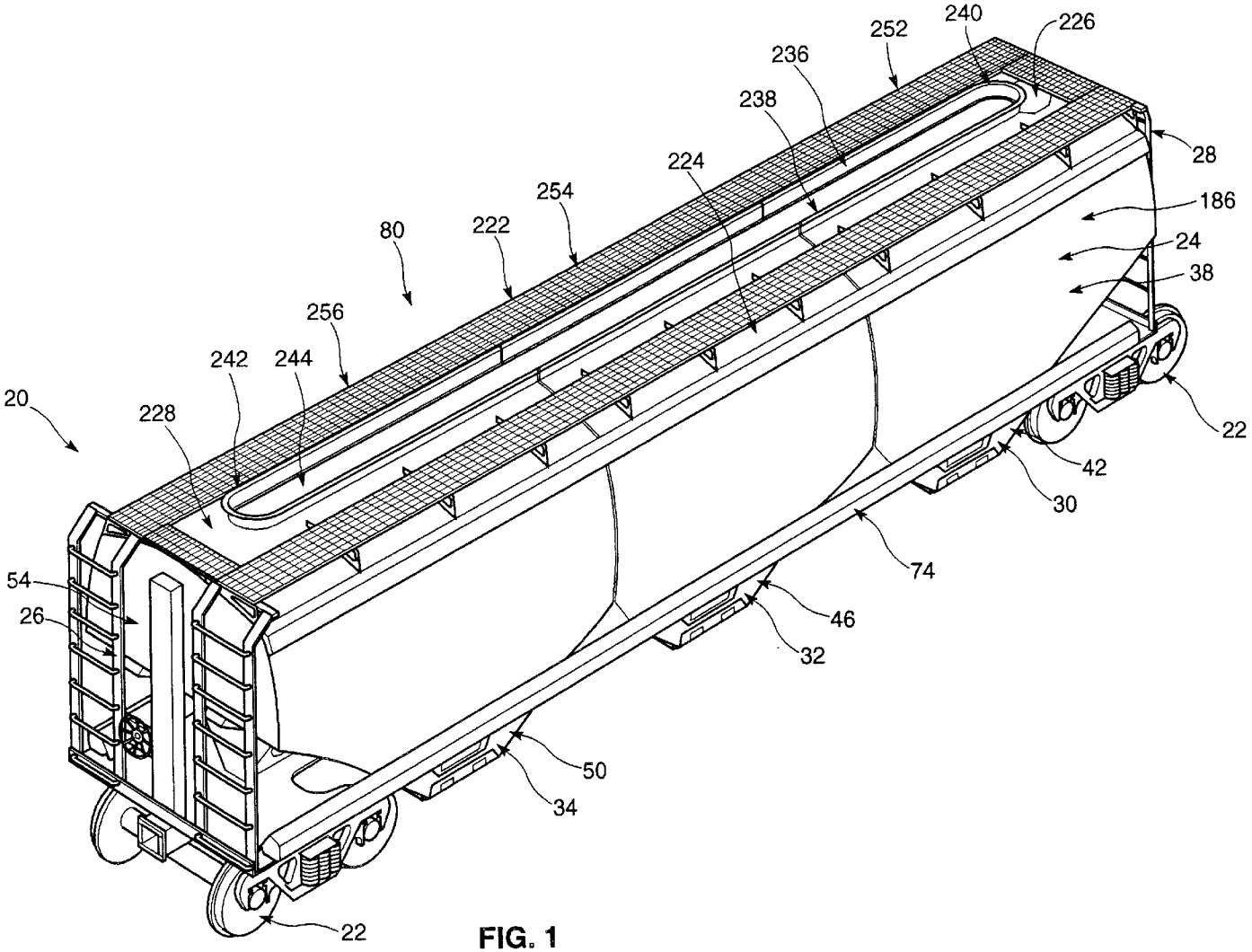
FIG. 1 is a general arrangement view of an hopper car incorporating the present invention.

The description of the invention is best understood by commencing with reference to FIG. 1, in which some proportions have been exaggerated for the purposes of conceptual illustration.

Referring to the preferred embodiment of FIGS. 1, 2, 3 and 4, a hopper car of all steel construction is shown generally as 20. It has trucks 22 in the customary manner, upon which a railcar body 24 rests. The body has end structures 26 and 28 supported on trucks 22. Three hoppers 30, 32 and 34 are defined by a combination of left and right main side walls 36 and 38, respectively; left and right hand, foremost, middle and rearmost inwardly downwardly sloping side sheets, 40, 42, 44, 46, 48, and 50, respectively; end walls 52 and 54; internal bulkhead partitions 56 and 58; and foremost and rearmost sloped sheets 60, 62, 64, 66, 68, and 70, tied together and reinforced by left and right hand side sills 72 and 74 and top chords beams 76 and 78 all of which are attached to end structures 26 and 28 and covered by a roof assembly 80.

In general terms, the roof assembly 80 and sidewalls 36 and 38 form a three sided, downwardly opening thin shelled structure, similar to a monocoque. This thin shell is, in effect, wrapped around endwalls 52 and 54 and bulkhead partitions 56 and 58 and extends downwardly to the level of side sills 72 and 74. End walls 52 and sloped sheet 60, endwall 54 and slope sheet 70, and bulkhead partitions 56 and 58 act in general terms as frames, or formers, forming a skeleton to which the monocoque-like structure is attached like a skin. The individual members of the structure are relatively thin and flexible alone, but when assembled work together mutually to stiffen each other and the entire structure. The ability of such a structure to bear service loads generally depends on the ability of the unsupported spans between the formers, to maintain their desired shape. The formers shown are all upstanding, but need not be vertically upstanding, and need not be parallel to give a desired stiffening effect when the skins are welded in place.

In the embodiment shown the distance between each adjacent pair of formers defines the fore-and-aft length of one of hoppers 30, 32, or 34. Generally speaking the sidewalls extend along the formers between the discharge assemblies of the hopper car, described below, and the superstructure which is typically a roof assembly. The steel sheet required for the sidewall has an overall sidewall sheet width from a lap joint located approximately at the level of the top of the side sill, to the top chord roof line measured along the arc of the wall, i.e., the developed width.

This structure will now be described in greater detail, commencing with end structures 26 and 28, and working, generally speaking, inwardly and upwardly. Inasmuch as the car is largely symmetrical, the following description made in the context of forward end structure 26 also applies to rear end structure 28.

As shown in FIGS. 5, 6, 7, 8 and 9, end structure 26 has a central longitudinally extending stub sill 100 in the form of a fabricated box beam which extends away from forward hopper 30 (or rearward hopper 34) of body 24. A standard coupler 102 is attached to the distal end of stub sill 100 so that car 20 may be linked to other rail cars. A transverse beam-like bolster structure 104 extends laterally from stub sill 100 and includes left and right hand arms 106 and 108. Each arm has a fabricated stepped beam structure with an outwardly tapering lower flange. Each arm also has a corresponding pair of parallel stepped webs. The depth of the webs decrease outwardly from the centreline 110 such that stub sill 100 and arms 106 and 108 form a cruciform 112 of varying depth of section. A lower, distal portion 114, 116 of each of arms 106 and 108 rests upon a side bearing and spring assembly of each of trucks 22 in the conventional manner. On the underside, at the intersection of cruciform 112 is a yoke 118, for location about the pivot of each of trucks 22.

Figure 5:
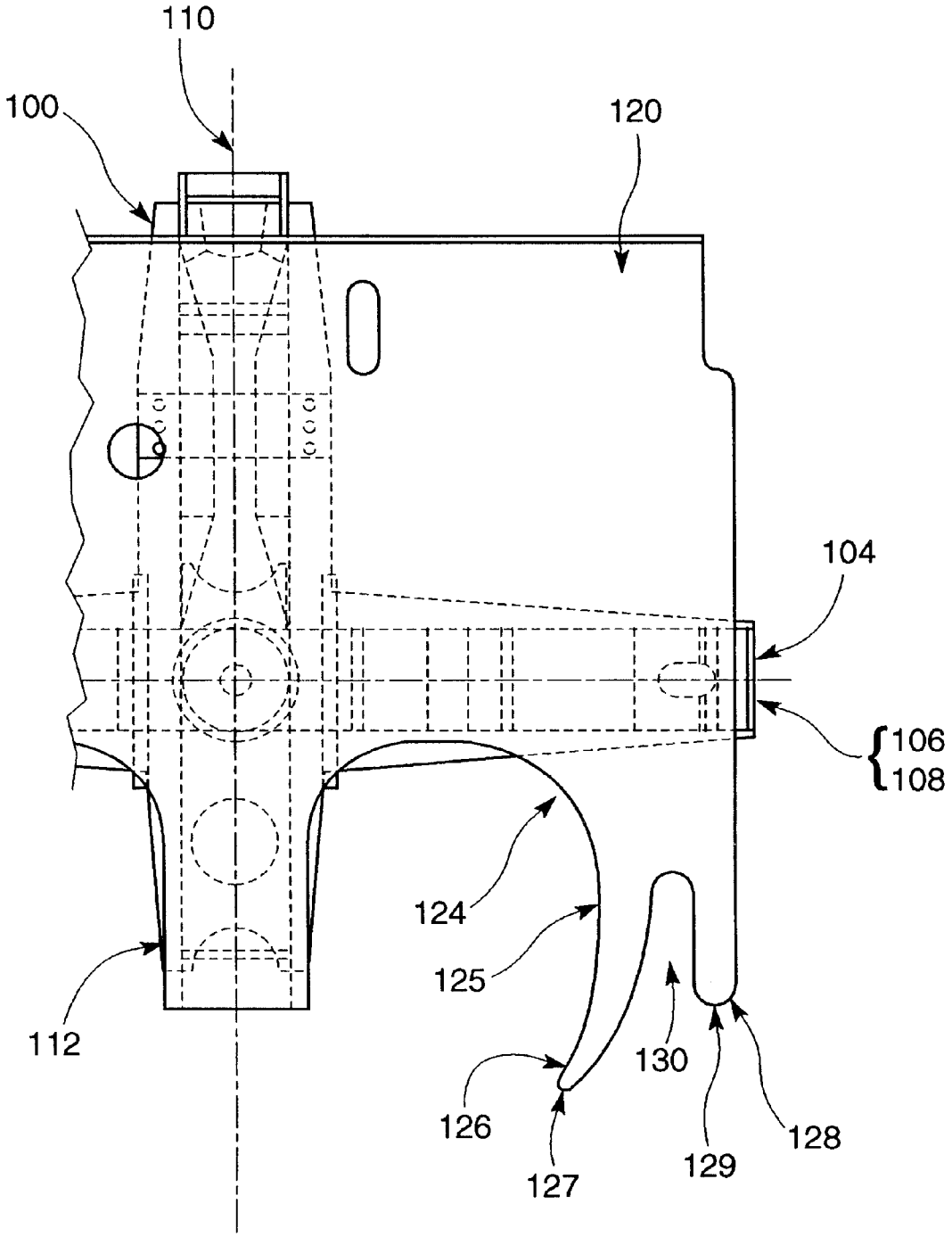
FIG. 5 is a half sectional plan view of a bolster and shear plate of the car of FIG. 1 taken on arrow '5'.
Figure 9:
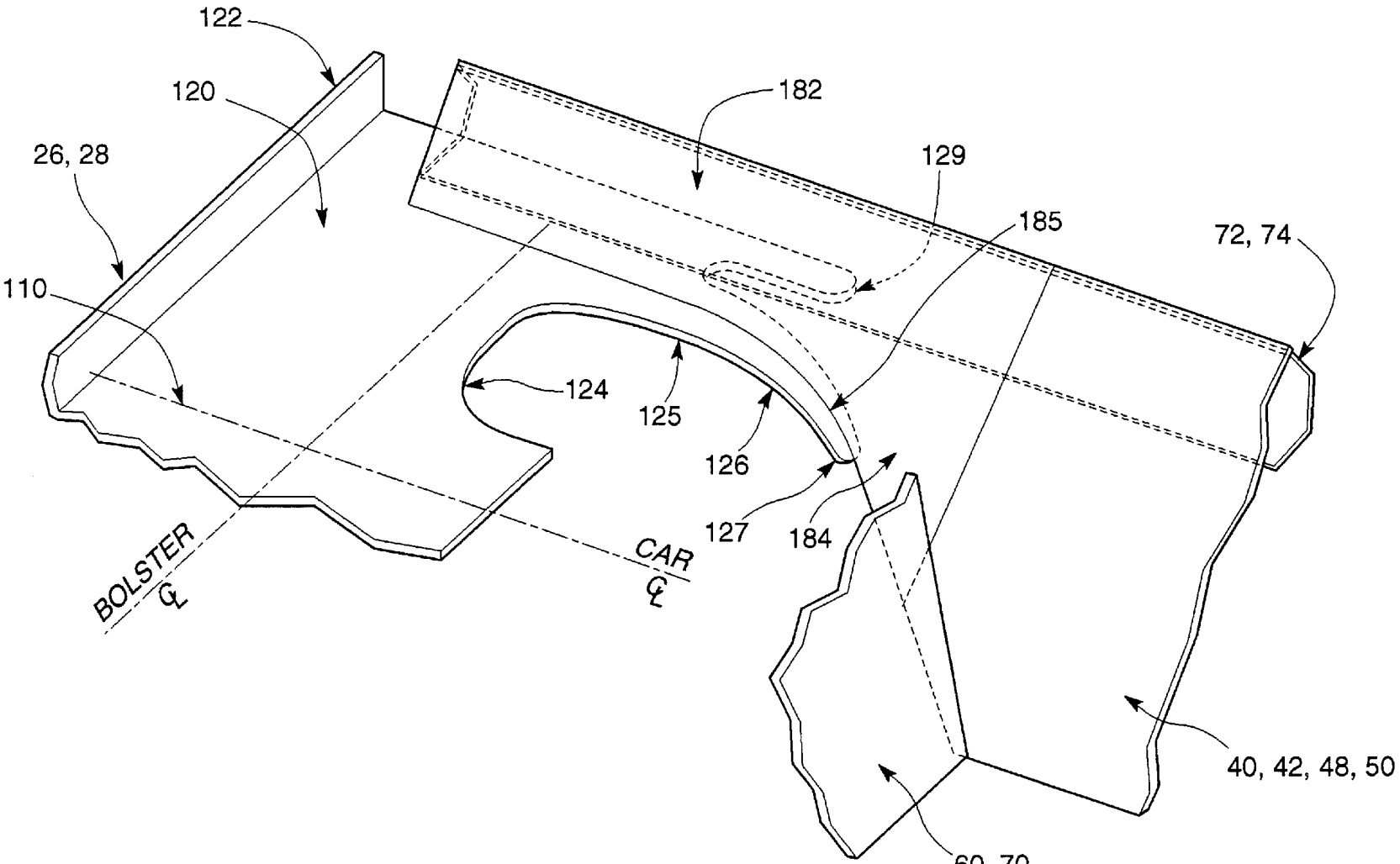
FIG. 9 is a sectional quarter view of a side sill transition of the car of FIG. 1.

The upper face of cruciform 112, lies in a single plane and is welded to a shear plate 120. Shear plate 120 has an upturned end flange 122, and an opposed bight-shaped wheel well rebate 124. Rebate 124 is bounded on its outer and foremost limit by a forwardly extending shear plate extension 126 emanating from a root 125 at the body of shear plate 120 and tapering to a distal tip 127, bent on a smooth radius downwardly, with an inwardly tending profile such that it can be welded to hopper 30 (or 34) in the manner described below. Outboard of shear plate extension 126 is a side sill tang 128 separated from shear plate extension by a tang relief 130. The most distant tip of tang 128 from bolster structure 104 is indicated as 129. As shown in FIGS. 5 and 9, distal tip 127 of shear plate extension 126 extends away from bolster structure 104 longitudinally beyond the longitudinal location of tip 129 of tang 128.

Figure 7:
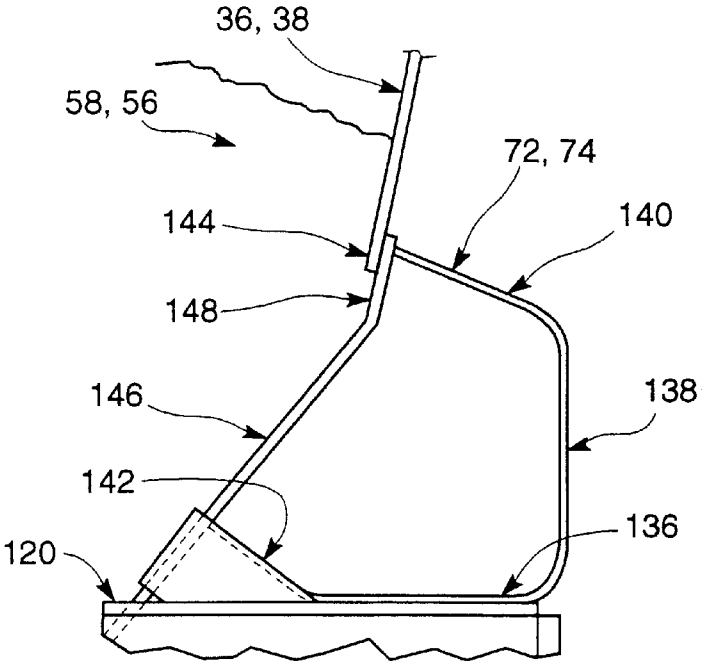
FIG. 7 is an enlarged detail of the side sill of FIG. 6.
Figure 6:
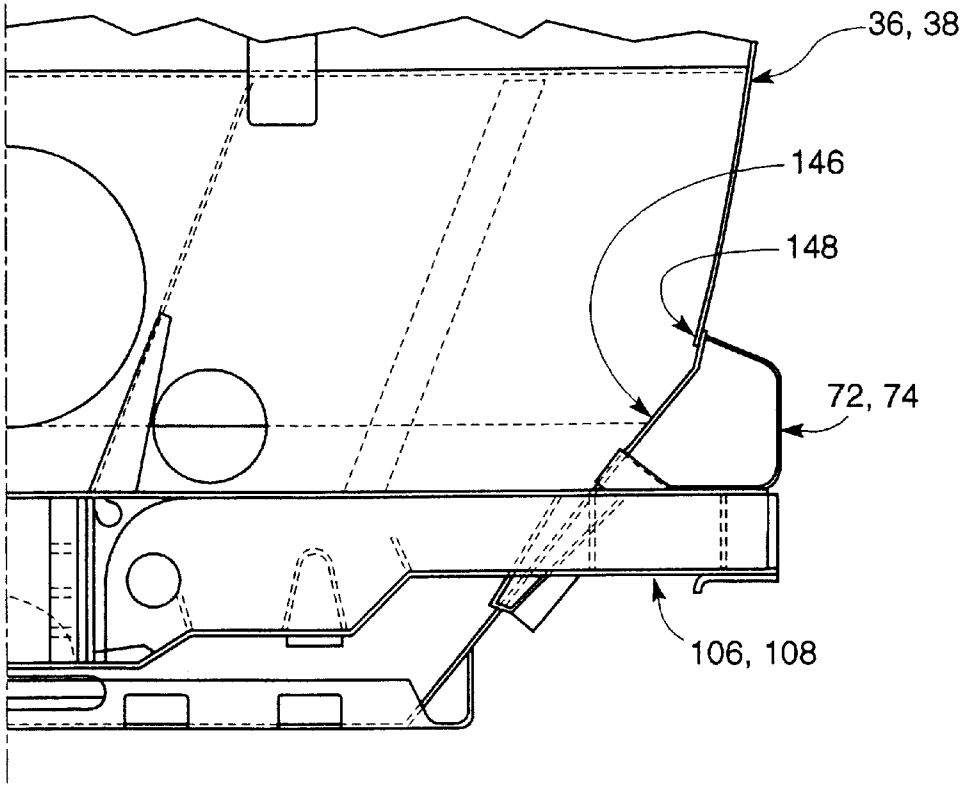
FIG. 6 is an end view detail of a side sill and bolster of the hopper car of FIG. 1 taken on arrow '6'.

The left and right hand, parallel, spaced apart, longitudinally extending side sills 72 and 74 rest upon, are welded to, and are supported by, the outboard margins of shear plate 120. The farthest extremities of side sills 72 and 74 extend along shear plate 120 to lie above, and to benefit from the support of, bolster structure arms 106 and 108. As shown in the section of FIG. 7, each of side sills 72 and 74 has an open, roll formed, smoothly radiused section having a first, horizontal wall 136 and an adjoining, outer vertical wall 138. The first horizontal wall 136 is for resting upon, and welding to, sheer plate 120. The adjoining, outer, vertical wall 138 gives onto an upwardly and inwardly angled upper leg 140. At the other extremity of the section, an angled lower leg 142 extends upwardly and inwardly from horizontal wall 136.

As shown in the enlarged detail of FIG. 7, which is typical, forward hopper side sheet 40 has a main planar, trapezoidally shaped lower portion 146, and a much smaller, minor upper portion designated as sill flange lip 148 bent at an angle for mating with the tangent angle of the lowermost portion of main side sheet 36. Furthermore, as is typical, forward bulkhead partition 58 is provided with a step, or notch, 144, into which the lower edge of side sheet 36 may seat. Legs 140 and 142 of side sill 72 extend to meet the upper and lower portions of forward hopper left hand side sheet 40, and, when welded thereto, form a stiff, closed hollow section.

Figure 2:
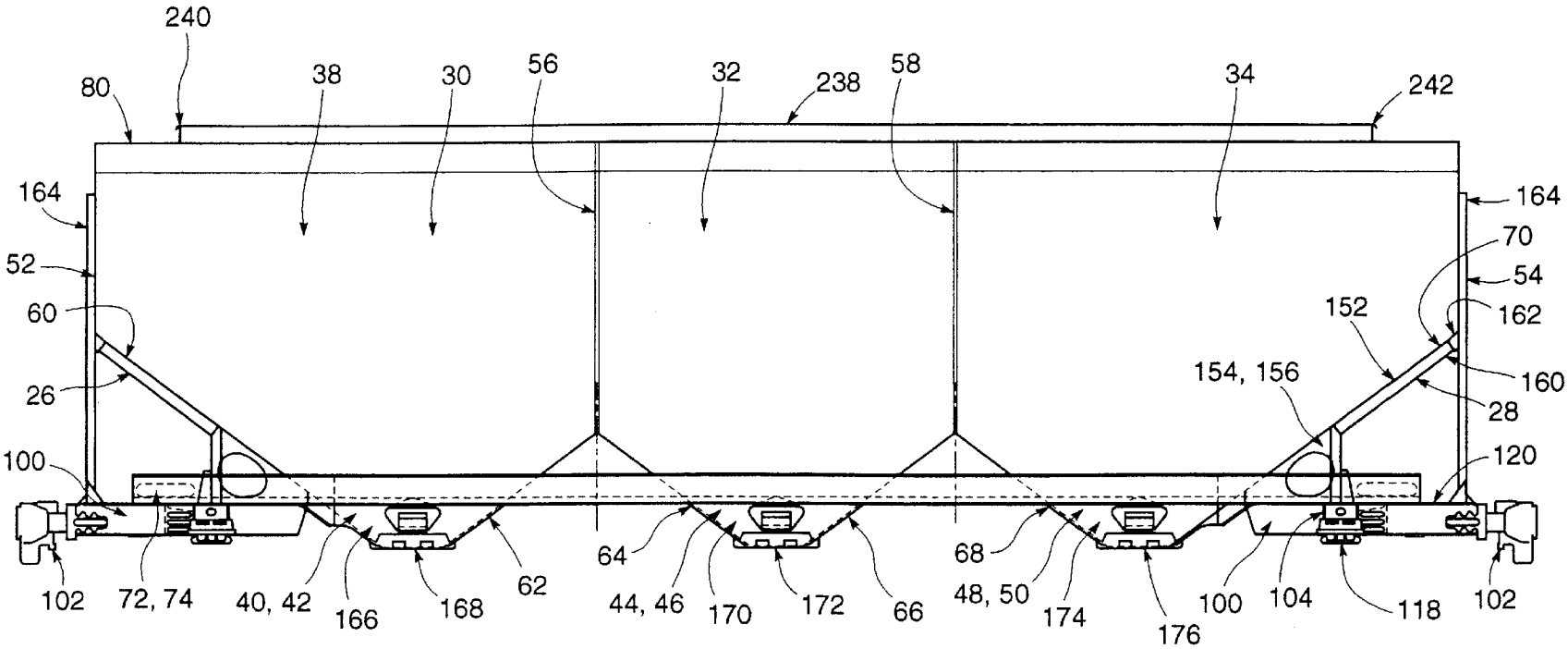
FIG. 2 is a longitudinal centre-line cross-section of the hopper car of FIG. 1 taken on section '2—2'.
Figure 3:
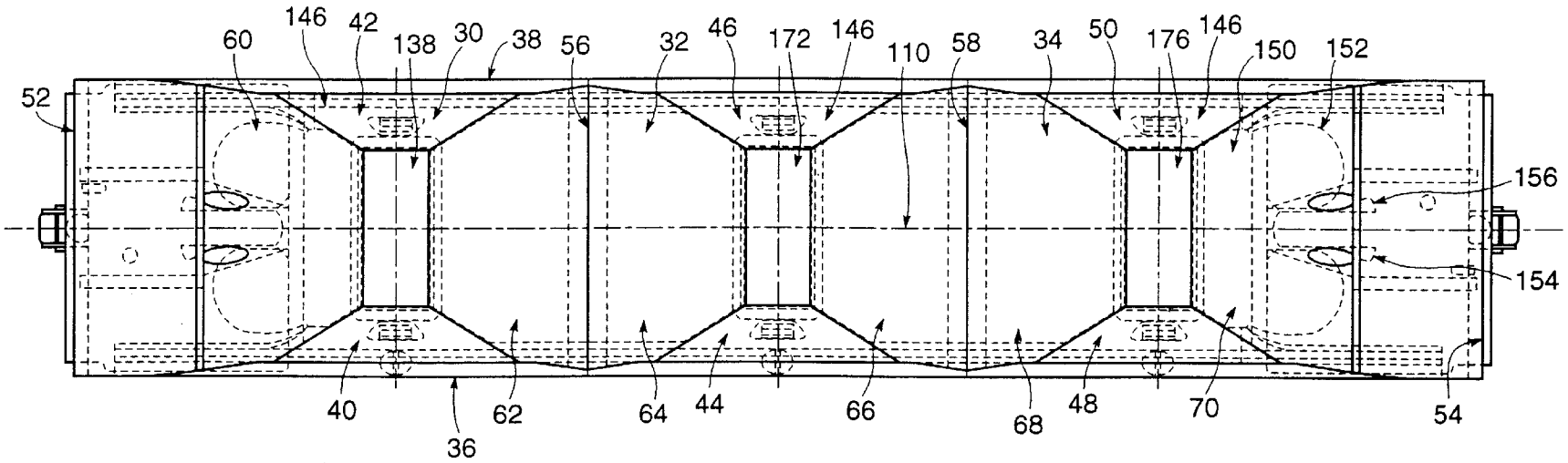
FIG. 3 is a plan section of the hopper of FIG. 1 taken on section '3—3'.
Figure 4:
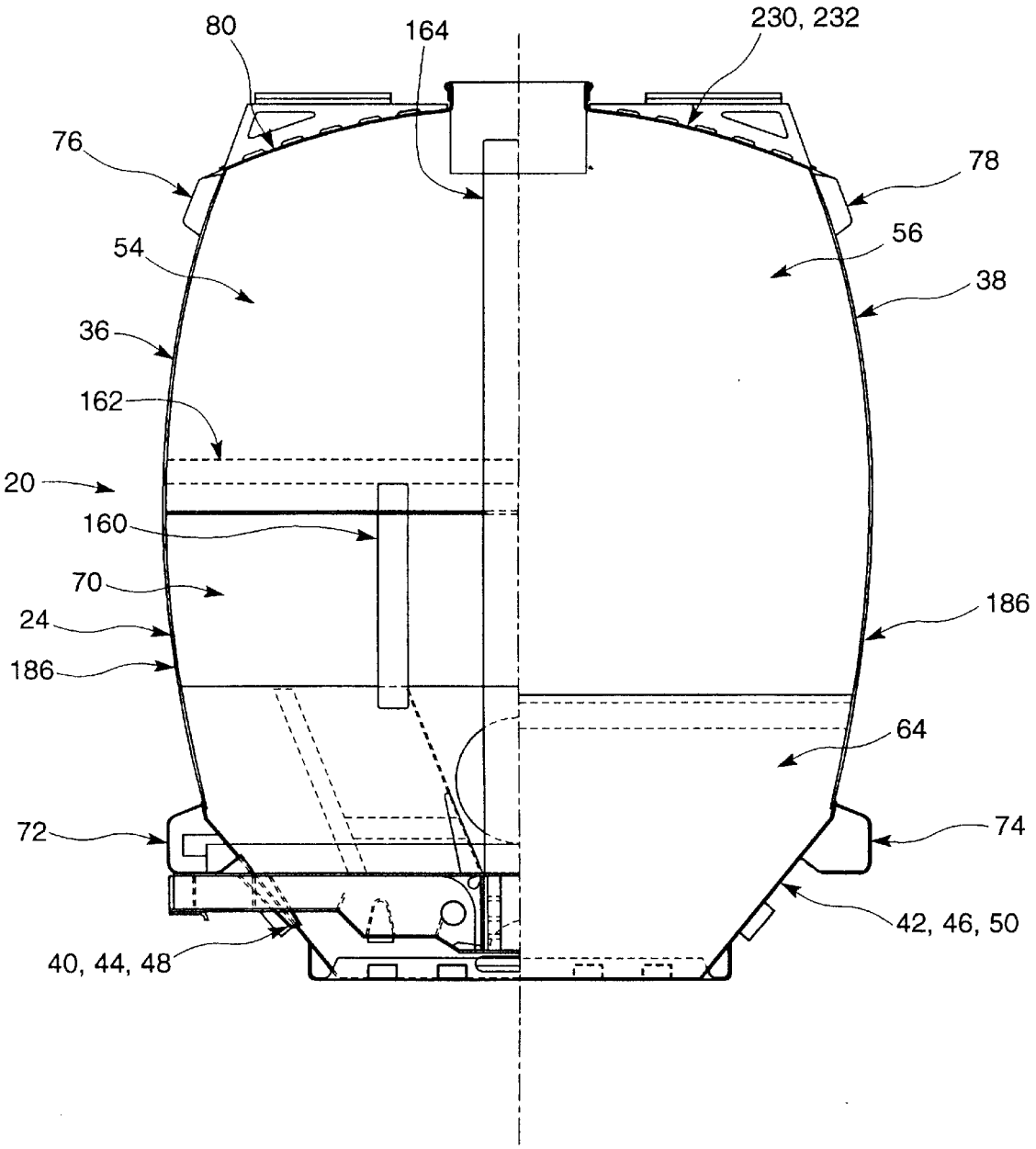
FIG. 4 is a lateral cross section of the hopper of FIG. 1 taken on section '4—4'.
Figure 8:
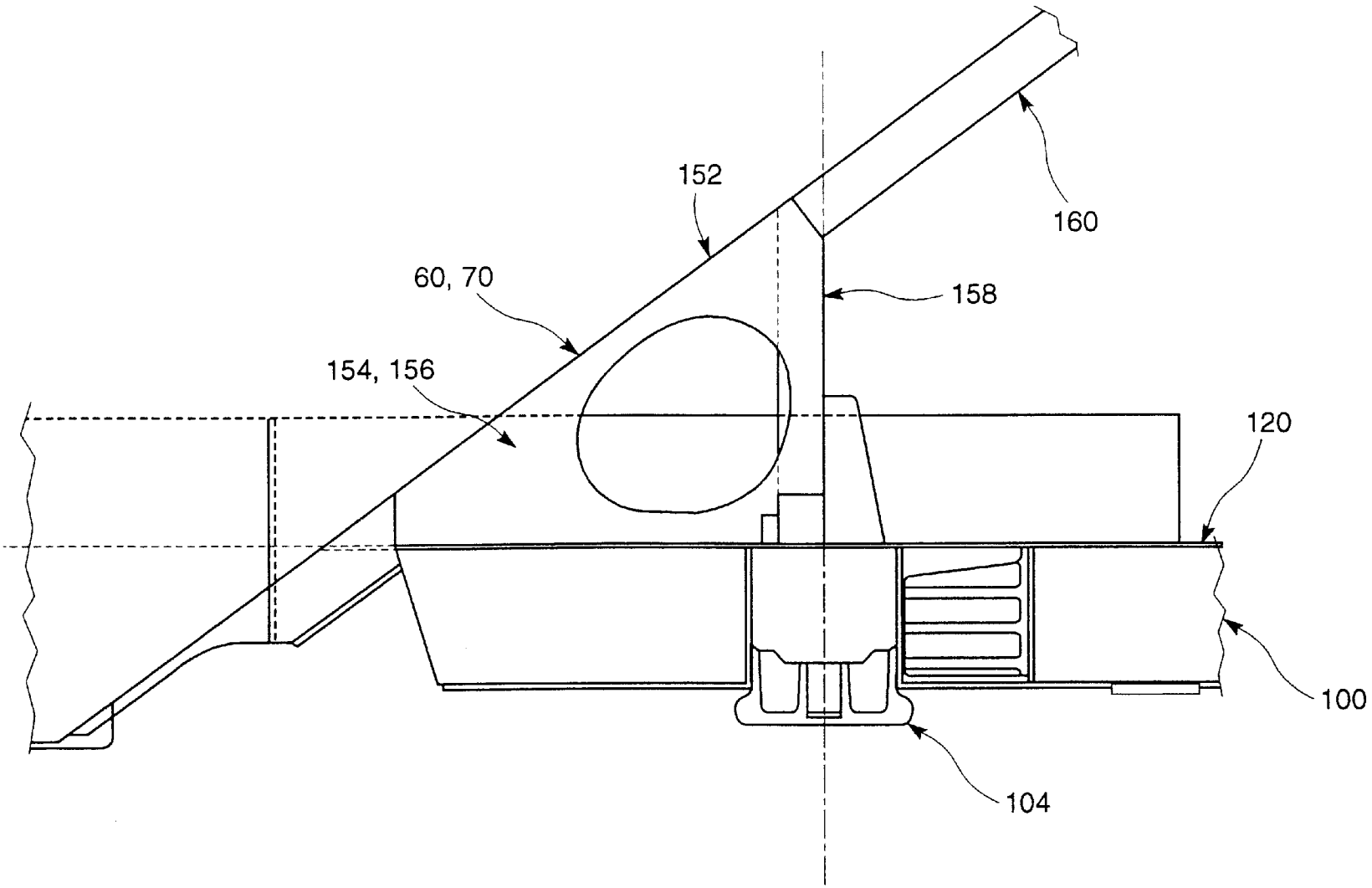
FIG. 8 is a side view detail of the bolster of FIG. 5.

As shown in FIGS. 2, 4 and 8, each of end hoppers 30 and 34 has an end slope sheet either 60 or 70. The end slope sheet has a trapezoidally shaped lower portion 150 and a main sidewall contour profile-following upper portion 152. The slope sheet 60 or 70 is supported from the inner end of stub sill 100 by generally triangular, lightening hole relieved, left and right hand gussets 154 and 156 welded at a compound, generally outwardly leaning angle therebetween. Both backed by a substantially vertically oriented transverse shear plate 158 which extends from bolster structure 104 upwardly to meet end slope sheet 60 or 70. A pair of parallel, spaced apart, channel shaped end slope sheet outer stiffeners 160 have their toes welded to end sheet 60 or 70. Stiffeners 160 extend upwardly along the slope of, end sheet 60 or 70, from shear plate 158 to an hollow, closed triangular section, laterally extending transom 162 . Transom 162 is located to support end hopper 30 or 34, as the case may be, at the intersection of end slope sheet 60 or 70 and vertically upwardly extending end wall 52 or 54. Finally, a stanchion, or stem post 164 extends vertically upward from the outer end of stub sill 100 to meet centrally, and to extend past, transom 162 and continues upwardly against end wall 52 or 54 to a level roughly equal to the height of top chords 76 and 78, described below.

Foremost hopper 30 is bounded by front end wall 52 and forward hopper slope sheet 60, described above. The foremost hopper 30 is also defined by an opposed, main side wall contour profile mating, forward bulkhead partition 56. The foremost hopper 30 is further bounded by left and right main side walls 36 and 38 which meet at their lower extremities with left and right downwardly and inwardly sloping, trapezoidally shaped forward hopper side sheets 40 and 42; trapezoidally shaped rearward slope sheets; and roof assembly 80, described below. The basic inverted rectangular pyramid structure of forward hopper discharge assembly 166, giving onto outlet 168, is formed by welding the mating seams of, opposed slope sheets 60 and 62 to opposed side sheets 40 and 42. Similarly, middle hopper 32 is bounded by partitions 56 and 58, main side walls 36 and 38, hopper side sheets 44 and 46, slope sheets 66, and roof assembly 80. Hopper 32 has a corresponding discharge assembly 170 and outlet 172.

The rearmost hopper 34 is bounded by rearward bulkhead partition 58, rear end wall 54, left and right main side sheets 36 and 38, left and right downwardly and inwardly sloping rear hopper side sheets 48 and 50, rear hopper forward and rearward slope sheets 68, 70, and roof assembly 80. Hopper 34 has a discharge assembly 174 and outlet 176.

The arrangement of structure at the intersection of shear plate 120 of end structure 26 (or 28), hopper end slope sheet 60 or 70 of hopper 30 or 34, and hopper side sheet 40, 42, 46 or 48, as the case may be, is illustrated, typically, in FIGS. 7, 8 and 9. Side sill 72 or 74 rests on shear plate 120. The two are welded together along the outer edge of shear plate 120, the inner edge of side sill 72 or 74, and around the peninsula shaped profile of tang 128 and tang relief 130. Hopper sloped side sheets 40, 42, 48 and 50 each have an extension 182 reaching out to lie along, and be welded to, the end portion of side sill 72 or 74. As shown, side sheets 40, 42, 48 and 50 extend past the locus of intersection with, and at which they are welded to, slope sheet 60 or 70 of end hopper 30 or 34. The side sheets 40 have a long, smooth, large radius transition section 184 which mates with the downward turned ear of shear plate extension 126. That is, as shown in FIG. 5, shear plate extension 126 if formed to lie along, and be attached to, the lower, curved edge 185 of transition section 184 of side sheet extension 182. As shown, shear plate extension 126 acts as a flange along the lower edge of side sheet extension 182. When welded together, use of this structure reduces the load which must be carried through side sills 72 and 74 from hopper 30 and 34 to shear plate 120, provides additional structure locally only, and, by being smooth, reduces or avoids the stress concentrations that might otherwise exist at the transition from side sill 72 or 74 to a more sharply edged shear plate. A consequent benefit is that the thickness of the section of side sills 72 and 74 need not be as thick as it might otherwise be, allowing a savings in material, and hence weight, along side sills 72 and 74.

As illustrated in the preferred embodiment of FIG. 1, main side walls 36 and 38 are each formed from a rolled sheet 186 of high strength steel with the rolling direction aligned longitudinally, for spanning the distance between end walls 52 and 54. Sheet 186 is cut to the desired developed profile, stepped into notches 144 and then deflected back to form up against the side profile of partitions 56 and 58. Sheet 186 is fillet welded once on the inside to the top of trapezoidal lower portions 176 of side sheets, and a second time externally along the edge of lips 178 of hopper side sheets 40, 44 and 48 or 42, 46 and 50, as the case may be, to form a lap joint.

Although a particular preferred embodiment of the invention, and a number of alternative embodiments have been described herein and illustrated in the figures, the principles of the present invention are not limited to those specific embodiments. The present invention is defined by the claims which follow.

I claim:

1. A transition section for carrying structural loads between an end hopper of a railway hopper car and a railway hopper car end structure carried on a truck, the hopper car having a pair of end structures each having a shear plate, and a pair of side sills extending longitudinally between the end structures, the end hopper having side sheets extending inwardly and downwardly of the side sills, the transition section comprising:

an extension of one of said side sheets, said side sheet extension extending along, and being attached to, one of the side sills between the end hopper and the end structure, the side sheet extension varying smoothly in section between the end hopper and the end structure; and a shear plate extension extending longitudinally from the shear plate toward the end hopper, said shear plate extension being formed to lie along and be attached to at least a portion of said smoothly varying section of said side sheet extension, said shear plate extension co-operating with the side sheet extension to act as a flange for at least a portion thereof.

2. The transition section of claim 1, the hopper car having a side sill of constant section extending between, and attached to, the end hopper and the end structure, wherein the side sheet extension reinforces the side sill between the end hopper and the end structure.

3. The transition section of claim 1 wherein the side sheet extension is formed integrally with the side sheet.

4. The transition section of claim 1 wherein the side sheet extension has a depth of section which diminishes toward the end structure.

5. The transition section of claim 4 wherein the side sheet extension has a smooth curved profile which melds with the profile of the side sheet and has a distal portion locatable to lie smoothly against the shear plate of the end structure.

6. The transition section of claim 1 wherein the shear plate extension has a root at the end structure and a tip remote from the end structure, and is of greater sectional the root than at the tip.

7. The transition section of claim 6 wherein the section diminishes smoothly from the root to the tip.

8. The transition section of claim 1, the hopper side sheet having an end slope edge generally oriented toward the end structure wherein:

the shear plate extension is formed integrally with the shear plate, the shear plate extension having a root at the shear plate and a tip distant therefrom, the shear plate extension tapering smoothly from the root to the tip, the shear plate extension being bent downwardly from the shear plate on a smooth, continuous curve; and the side sheet extension has a smooth curve profile which melds with the end slope edge and has a distal portion lying smoothly against the shear plate of the end structure.

9. A rail road hopper car comprising:

a pair of end structures each supported on a railway car truck, each of said end structures having a stub sill, a bolster extending transversely from said stub sill, and a shear plate mounted upon said bolster and stub sill;

said hopper car having a pair of side sills mounted to, and extending between, said end structures, said side sills being mounted to said shear plates of said end structures;

an end hopper mounted adjacent to one of said end structures, said end hopper having a pair of sloped side sheets and a pair of sloped end sheets, said side sheets and end sheets co-operating to form an inverted pyramidal hopper discharge;

each of said side sheets being attached to one of said side sills, and having a side sheet extension formed to extend therealong toward the shear plate of the adjacent end structure, said side sheet extension having a lower edge;

each said shear plate having a shear plate extension formed to lie against, and be attached to, said lower edge of said side sheet extension, whereby said shear plate extensions acts as a flange for said side sheet extension.

10. The hopper car of claim 9 wherein said lower edge of said side sheet extension has a smoothly curved profile, and said shear plate extension is bent to follow said profile.

11. The hopper car of claim 9 wherein said shear plate extension has a root and a tip, said root being wider than said tip.

12. The hopper car of claim 9 wherein each said shear plate extension extends longitudinally away from the main bolster to a distal tip located longitudinally further from said bolster than the furthest point from said bolster at which the side sill adjacent thereto is joined to said side sheet extension.

13. The hopper car of claim 9, the car having a longitudinal centerline, and wherein said lower edge of said side sheet extension runs inwardly and downwardly toward said centerline, and said shear plate extension is also bent to extend inwardly and downwardly to mate with said lower edge.

14. The hopper car of claim 9 wherein said side sheet extension is formed integrally with said side sheet.

15. The hopper car of claim 9 wherein said side sills are of constant section and said side sheet extensions lie along, and reinforce, the respective side sills to which they are attached.

16. The hopper car of claim 15 wherein said side sills each include a roll formed section, and said side sheet extensions are welded thereto to form a closed section.

17. The hopper car of claim 2 wherein said side sills each include a roll formed section, and said side sheet extensions are welded thereto to form a closed section.

* * * * *